US005483863A

United States Patent [19]

Dreizin

[11] Patent Number: 5,483,863

[45] Date of Patent: Jan. 16, 1996

[54] ELECTROMAGNETIC LAUNCHER WITH ADVANCED RAIL AND BARREL DESIGN

[75] Inventor: Yuri A. Dreizin, Minneapolis, Minn.

[73] Assignee: Dyuar Incorporated, Minneapolis, Minn.

[21] Appl. No.: 108,710

[22] PCT Filed: Apr. 26, 1993

[86] PCT No.: PCT/US93/03885

§ 371 Date: Sep. 13, 1993

§ 102(e) Date: Sep. 13, 1993

[87] PCT Pub. No.: WO93/22609

PCT Pub. Date: Nov. 11, 1993

Related U.S. Application Data

[63] Continuation-in-part of Ser. No. 874,781, Apr. 27, 1992, Pat. No. 5,297,468.

[51] Int. Cl.[6] ..... F41B 6/00

[52] U.S. Cl. ..... 89/8; 124/3

[58] Field of Search ..... 89/8; 124/3

[56] References Cited

U.S. PATENT DOCUMENTS

| | | | |
|---|---|---|---|
| 1,421,435 | 7/1922 | Fauchon-Villeplee | 89/8 |
| 1,422,427 | 7/1922 | Fauchon-Villeplee | 89/8 |
| 1,679,518 | 8/1928 | Fowle | 428/686 |
| 3,126,789 | 3/1964 | Meyer | 89/8 |
| 3,878,409 | 4/1975 | Gill et al. | 310/11 |
| 3,918,557 | 11/1975 | Ross, Sr. | 191/59.1 |
| 4,061,627 | 12/1977 | Conrow et al. | 260/178 |
| 4,200,831 | 4/1980 | Weldon et al. | 322/8 |
| 4,369,691 | 1/1983 | Baehr, Jr. et al. | 89/8 |
| 4,423,662 | 1/1984 | McAllister | 89/8 |
| 4,433,607 | 2/1984 | Kemeny | 89/8 |
| 4,457,205 | 7/1984 | Ross | 89/8 |
| 4,459,504 | 7/1984 | Weldon et al. | 310/243 |
| 4,467,696 | 8/1984 | McNab et al. | 89/8 |
| 4,485,720 | 12/1984 | Kemeny | 89/8 |
| 4,608,908 | 9/1986 | Carlson et al. | 89/8 |
| 4,625,618 | 12/1986 | Howanick | 89/8 |
| 4,694,729 | 9/1987 | Hall | 89/8 |
| 4,753,153 | 6/1988 | Jasper, Jr. | 89/8 |
| 4,831,913 | 5/1989 | Jasper, Jr. | 89/8 |
| 4,870,888 | 10/1989 | Weldon et al. | 89/8 |
| 4,884,489 | 12/1989 | Zowarka et al. | 89/8 |
| 4,913,030 | 4/1990 | Reynolds | 89/8 |

(List continued on next page.)

FOREIGN PATENT DOCUMENTS

| | | | |
|---|---|---|---|
| 2250803 | 10/1972 | Germany . | |
| 236597 | 10/1991 | Japan | 89/8 |
| 2141215 | 12/1984 | United Kingdom | 89/8 |

OTHER PUBLICATIONS

J. Barber, A. Chillita, B. Maas, L. Thurmond, *Contact Transistion in Metal Armatures,* IEEE Trans. Mag. vol. 27, No. 1, pp. 228–232 (Jan. 1991).

J. P. Barber, A Chillita, *Velocity Effects on Metal Armature Contact Transition,* Presented at 6th Symposium on Electromagnetic Launch Technology, Austin, Texas (Apr.

(List continued on next page.)

*Primary Examiner*—Stephen C. Bentley

*Attorney, Agent, or Firm*—Kinney & Lange

[57] ABSTRACT

An improved electromagnetic launcher (10; 98; 150) has a barrel (20; 100) formed by at least one pair of bus-bars (30, 32; 102, 104; 156, 158; 184, 184, 188, 190) to transport current longitudinally along the barrel. The barrel includes a bore (36; 108) which is spaced from the bus-bars by a bore structure (34; 106). The bore structure guides an elongated, tapered metal armature (44; 122; 164) through the bore. The current to the armature passes from the bus-bars through an array of deformable contactors (54, 55; 110, 112) disposed near the bore walls and in series with resistors (60, 62, 64, 66; 114, 116, 118, 120). The resistors distribute current and electromagnetic driving force along the armature. A conductive implodable shield (130) confines the bore structure and the bus-bars to impede repulsion of the bus-bars and to compress the magnetic flux between the shield walls and the bus-bars.

17 Claims, 9 Drawing Sheets

U.S. PATENT DOCUMENTS

| | | | |
|---|---|---|---|
| 4,924,750 | 5/1990 | Neugebauer | 89/8 |
| 4,944,212 | 7/1990 | Hilal | 89/8 |
| 4,945,810 | 8/1990 | Parker | 89/8 |
| 4,953,441 | 9/1990 | Weldon et al. | 89/8 |
| 5,076,136 | 12/1991 | Aivaliotis et al. | 89/8 |
| 5,078,042 | 1/1992 | Jensen | 89/8 |
| 5,095,802 | 3/1992 | Reynolds | 89/8 |
| 5,138,929 | 8/1992 | Weldon et al. | 89/8 |
| 5,297,468 | 3/1994 | Dreizin | 89/8 |

OTHER PUBLICATIONS

28–30 1992); also published in IEEE Trans. Mag., vol. 29, No. 1, pp. 733–738 (Jan. 1993).

D. P. Bauer, J. P. Barber and H. F. Swift, *Application of Electromagnetic Accelerators to Space Propulsion,* IEEE Trans. Mag., vol. Mag–18, No. 1, pp. 170–175 (Jan. 1982).

A. J. Bedford, *Rail Damage and Armature Parameters for Different Railgun Materials,* IEE Trans. Mag., vol. Mag–20, No. 2, pp. 352–355 (Mar. 1984).

A. L. Brooks, R. S. Hawke, J. K. Scudder and C. D. Wozynski, *Design and Fabrication of Large and Small Bore Railguns,* IEEE Trans. Mag., vol. Mag–18, No. 1, pp. 68–81 (Jan. 1982).

R. Burton et al., *Performance of a Self–Augmented Railgun,* J. Appl. Phys., vol. 10, No. 7, p. 80–84 (Jan. 1991).

M. Cowan, *Pulsed Power for Electromagnetic Launching,* IEEE Trans. Mag., vol. Mag–18, No. 1, pp. 145–150 (Jan. 1982).

F. J. Deadrick, R. S. Hawke and J. D. Scudder, *Magrac—A Railgun Simulation Program,* IEEE Trans. Mag., vol. Mag–18, No. 1, pp. 94–104 (Jan. 1982).

D. W. Deis and I. R. McNab, *A Laboratory Demonstration Electromagnetic Launcher,* IEEE Trans. Mag., vol. Mag–18, No. 1, pp. 16–22 (Jan. 1982).

D. W. Deis and D. P. Ross, *Experimental Launcher Facility—ELF–I: Design and Operation,* IEEE Trans. Mag., vol. Mag–18, No. 1, pp. 23–28 (Jan. 1982).

H. D. Fair, *Application of Electric Launch Systems,* Presented at 6th Symposium on Electromagnetic Launch Technology, Austin, Texas (Apr. 28–30, 1992); also published in IEEE Trans Mag., vol. 29, No. 1, pp. 342–344 (Jan. 1993).

H. D. Fair, Jr., *Electromagnetic Propulsion: A New Initiative,* IEEE Trans. Mag., vol. Mag–18, No. 1, pp. 4–6 (Jan. 1982).

C. M. Fowler, D. R. Peterson, R. S. Caird, D. J. Erickson, B. L. Freeman and J. C. King, *Explosive Flux Compression Generators for Rail Gun Power Sources,* IEEE Trans. Mag., vol. Mag–18, No. 1, pp. 64–67 (Jan. 1982).

R. Hawke, *Railgun Accelerators for Launching 0.1–g Payloads at Velocities Greater Than 150 km/s,* Lawrence Livermore Lab. Rep. No. CONF–790741–1 (Jun. 15, 1979), DOE Impact Fusion Workship GRAI8004, NSA0400.

R. S. Hawke, A. L. Brooks, F. J. Deadrick, J. K. Scudder, C. M. Fowler, R. S. Caird and D. R. Peterson, *Results of Railgun Experiments Powered by Magnetic Flux Compression Generators,* IEEE Trans. Mag., vol. Mag–18, No. 1, pp. 82–93 (Jan. 1982).

T. James, *Performance Criteria for EM Launchers with Solid or Transistion Armatures and Laminated Rails,* IEEE Trans. Mag., vol. 27, No. 1, pp. 482–489 (Jan. 1991).

F. Jamet et al., *Some Aspects of Future Military Requirements,* Presented at 6th Symposium on Electromagnetic Launch Technology, Austin, Texas (Apr. 28–30 1992); also published in IEEE Trans. Mag., vol. 29, No. 1, pp. 351–353 (Jan. 1993).

H. Kolm, *Electromagnetic Accelerator Concepts,* DOE Impact Fusion Workshop, Los Alamos, N. Mex. (Jul. 10–12, 1979), Available from NTIS, Springfield, Va. pp., 206–217 (1979).

R. N. Kostoff, A. T. Peaslee, Jr. and F. L. Ribe, *Possible Application of Electromagnetic Guns to Impact Fusion,* IEEE Trans. Mag., vol. Mag–18, No. 1, pp. 194–196 (Jan. 1982).

C. G. Long, *Fundamental Limits to the Velocity of Solid Armatures,* Doctoral Dissertation, University of Texas at Austin, pp. 15–22 (Aug. 1987).

G. C. Long and W. F. Weldon, *Limits to the Velocity of Solid Armatures in Railguns,* IEEE Trans. Mag., vol. 25, No. 1, pp. 347–352 (Jan. 1989).

J. Marshall, *Kaliski's Explosive Driven Fusion Experiments,* DOE Impact Fusion Workshop, Rep. No. CONF–790741–6, NTIS LA–UR–79–1840, pp. 441–449, Los Alamos, N. Mex. (Jul. 10, 1979).

R. Marshall, *Railgun Overview,* DOE Impact Fusion Workshop, Los Alamos, N. Mex. (Jul. 10–12, 1979) Available from NTIS, Springfield, Va. pp. 128–145.

R. Marshall, *The Use of Nested Chevron Rails in a Distributed Energy Storage Railgun,* IEEE Trans. Mag., vol. Mag–20, No. 2, pp. 389–390 (Mar. 1984).

P. Mongeau and F. Williams, *Arc–commutated Launcher,* IEEE Trans. Mag., vol. Mag–18, No. 1, pp. 42–45 (Jan. 1982).

D. O'Callaghan, *The UK Perception of Electromagnetic Technology,* Presented at 67th Symposium on Electromagnetic Launch Technology, Austin, Texas (Apr. 28–30); also published in IEEE Trans. Mag., vol. 29, No. 1, pp. 354–355 (Jan. 1993).

J. Parker, *Muzzle Shunt Augmentation of Conventional Railguns,* IEEE Trans. Mag., vol. 27, No. 1, pp. 80–84 (Jan. 1991).

P. B. Parks, *Current Melt–Wave Model for Transitioning Solid Armature,* J. Appl. Physics, vol. 67, No. 7, pp. 3511–3516 (Apr. 1990).

D. R. Petersen, *Magnetic Design for Structural Stiffness: The Tailored Railgun,* Presented at 6th Symposium on Electromagnetic Launch Technology, Austin, Texas (Apr. 28–30 1992); also published in IEEE Trans. Mag., vol. 29, No. 1, pp. 1201–1206 (Jan. 1993).

D. Peterson et al., *Rail Gun Powered by an Integral Explosive Generator,* Los Alamos Nat. Lab. Rep. LA–8000–C (May 1979).

I. M. Vitkovitsky, R. D. Ford, D. Jenkins and W. H. Lupton, *Homopolar Current Source for Mass Accelerators,* IEEE Trans. Mag., vol. Mag–18, No. 1, pp. 157–159 (Jan. 1982).

F. J. Young and W. F. Hughes, *Rail and Armature Current Distributions in Electromagnetic Launchers,* IEEE Trans. Mag., vol. Mag–18, No. 1, pp. 33–41 (Jan. 1982).

20
14
38
80
30
34
50
36
54
54A
55
55A
32

ELECTROMAGNETIC LAUNCHER WITH ADVANCED RAIL AND BARREL DESIGN

This is a continuation-in-part of prior application Ser. No. 07/874,781, filed Apr. 27, 1992 and issued as U.S. Pat. No. 5,297,468 on Mar. 29, 1994.

BACKGROUND OF THE INVENTION

The present invention relates to electromagnetic launchers, and more specifically to electromagnetic railguns, designed to accelerate solid bodies to higher velocities than those of conventional guns.

Electromagnetic launchers have been widely investigated because of the potential to achieve velocities exceeding those that can be practically attained in powder and other thermodynamic guns, in which the maximum velocity is limited by the specific energy of the known propellants. If high enough velocities could be obtained efficiently, electromagnetic launchers would have important military, scientific and commercial applications. The applications include testing and developing new materials, earth-to-orbit launching of materials, such as fuel, building and hazardous materials, and simulation of nuclear fusion impact with velocities on the order of 100 km/s.

The best known and most investigated electromagnetic launchers belong to the railgun family, in which projectiles are accelerated by an electromagnetic driving force applied to plasma or metallic armatures. The armature closes a circuit formed by a pulsed electric power source and a pair of parallel, elongated conducting rails. The power source generates current pulses in the rail-armature circuit. The rails form a railgun bore along which the projectile slides as it is accelerated by electromagnetic forces. U.S. Pat. No. 4,953,441 provides a brief description of the current state of railgun technology and a discussion of potential advantages of railguns with solid armatures.

Early railguns used metal armatures. During acceleration, the metal armatures were heated by the current pulse. If the contact is ideal and the current in the metal armature is distributed uniformly, there exists a theoretical velocity limit due to thermal degradation of the armature material. The theoretical velocity limit for a copper or an aluminum slug-shaped, unloaded armature having a length of about 1 cm is several tens of kilometers per second. The theoretical limit increases proportionally to the armature length. Experimentally, the sliding contact experiences arcing at velocities about or below 1 km/s. No increase of velocity with armature length is found.

In recent years, understanding in the causes of arcing at the sliding contact has revealed two principal causes. First, strong repelling forces between the rails cause the rails to deflect, creating gaps between the sliding armature and the rails. Second, velocity skin effect results in concentration of current near the trailing edge of the contact zone causing thermal degradation of the armature.

The repelling forces are applied mainly behind the armature, but they generate elastic deformations traveling along the rails which may outrun the armature and deflect the rails. To avoid the gaps and to maintain a tight contact, the rail deflections should be minimized. Prior teachings suggest increasing the stiffness of the railgun barrel structure to withstand the repelling forces. Techniques have been developed to provide for sufficient structural stiffness of barrels, resulting in a high barrel mass per unit length.

Even with stiff barrels, metal armatures should be designed to maintain the electromechanical contact during the launch. Armatures are usually inserted in the bore with substantial interference. Elastic, magnetic or inertial forces are often used to maintain pressure at the contact. Although a variety of armature designs have been developed and tested, maintaining a reliable contact, especially at the elongated contact zone for launching massive payloads to high velocities, remains a problem.

Moreover, if the sliding contact pressure occasionally becomes too high, gouging may occur. Excessive contact pressure may occur when the projectile begins to ballot within the bore. Further, high current density at the sliding contact causes superheating which degrades the mechanical properties of the armature and rail materials near the contact, which facilitates gouging. Gouging may greatly damage the contact surfaces of the rails and the armature and impede achieving high velocities.

The second cause of degradation of the sliding contact is the velocity skin effect. The velocity skin effect results in current concentration near the trailing edge of the contact area. The characteristic width of the current concentration zone depends upon the resistivities of the rails and the armature. The width of the zone decreases with increasing velocity. At a velocity of 1 km/s, the width of the zone may be of order of 1 mm or less. Extremely high current density in the zone causes thermal degradation/melting of the armature material in the vicinity of trailing edge of the sliding contact. This results in the destruction of the initially tight contact near the trailing edge.

As the armature material degrades, causing a gap between the armature and the rails, the zone of current concentration shifts to the trailing edge of the undamaged contact area. The entire process continues, causing a wave of contact degradation to propagate from the trailing edge of the contact zone toward the leading edge. When the entire contact is destroyed, arcing transition occurs. Theoretical models of this process were presented in P. Parks, *Current/Melt Wave Model for Transitioning Solid Armature*, J. Appl. Phys., Vol. 67, No. 7, pp. 3511–3516 (April 1990); T. James, *Performance Criteria for EM Rail Launchers with Solid or Transitional Armatures and Laminated Rails*, IEEE Trans. Mag., Vol. 27, No. 1, pp. 482–489 (January 1991); and Y. Dreizin, *Solid Armature Performance with Resistive Rails*, IEEE Trans. Mag., Vol. 29, No. 1, pp. 798–803 (January 1993). The velocity skin effect was also studied by a number of other authors, the first systematic analysis being published by Young and Hughes, *Railgun and Armature Current Distributions in Electromagnetic Launchers*, IEEE Trans. Mag., Vol. 20, No. 2, pp. 33–41 (January 1982).

A number of methods were proposed to diminish current concentration due to the velocity skin effect. One proposal concerns increasing the armature resistivity and using laminated (chevron type) armatures to reduce the current concentration. However, the zone of thermal degradation of the armature material near the contact becomes deeper in more resistive armatures. This increases the risk of destroying the armature during the launch. R. A. Marshall proposed "chevron" rails in, *The use of Nested Chevron Rails in a Distributed Energy Store Railgun*, IEEE Trans. Mag., Vol. 20, No. 2, pp. 389–390 (March 1984). The chevron rails use a number of independent power sources with short current pulses to control plasma armature behavior.

Another approach to solve the problem of arcing at the sliding contact is based on an augmented railgun. The augmented railgun involves a trade-off between the current passing through the armature and the magnetic field strength. If the current is decreased by a certain factor and the magnetic field is increased by the same factor, then the electromagnetic driving force will remain the same and the thermal effect will become smaller. However, limitations in the magnetic field strength due to the finite strength of the materials of the railgun structure do not completely allow for the trade-off just described. Instead, the magnetic field usually remains approximately the same (near the maximum possible level) while the current is reduced and the railgun is made longer to compensate for the reduction of driving force. To provide for a high magnetic field with the reduced current, additional rails are used, parallel to the main rails and energized from the same power source or from separate sources.

A self-augmented railgun is described in R. Burton, F. Witherspoon & S. Goldstein, *Performance of a Self-Augmented Railgun*, J. Appl. Phys., Vol. 10, No. 7, pp. 3907–3911 (October 1991) and in J. Parker, *Muzzle Shunt Augmentation of Conventional Railguns*, IEEE Trans. Mag., Vol. 27, No. 1, pp. 80–84 (January 1991). In a self-augmented railgun, a part of the current supplied by the power source at the breech end is not closed by the armature circuit, but is transported to the muzzle end where the circuit is closed by a conducting shunt. The magnetic field in front of the armature can be commensurate with the magnetic field behind the armature, so the average magnetic field at the armature increases as the armature moves from the breech end to the muzzle end. This partly compensates for the current reduction in the armature. For example, if the current is divided equally between the armature and the muzzle shunt, then the driving force is decreased only by one fourth while the thermal effects in the bulk of the armature and at the contact become four times lower.

Several researchers have experimented with multi-armature, multi-rail railguns. In such railguns, two or more pairs of parallel rails extend along the bore and may be energized independently. A corresponding number of armatures are disposed along the projectile. Each armature contacts one pair of rails. This configuration helps to distribute the electromagnetic driving force over the length of the launch package, but the arcing transition problem remains essentially the same.

Another method for reducing current concentration at the armature-rail contact was proposed in U.S. Pat. No. 4,953,441. There, the railgun comprises a laminated rail consisting of a high conductivity layer (copper) and an adjacent low conductivity layer. The low conductivity layer has a sliding contact with the armature. The high conductivity layer transports the current from the breech end of the rail to the location of the armature, while the low conductivity layer controls the current distribution at the contact to prevent current concentration. Certain difficulties, including superheating and thermal degradation of the low conductivity layer due to Joule dissipation, would be anticipated with the use of laminated rails.

Another problem in electromagnetic launch technology relates to the pulsed power supply. The performance of conventional electric sources and inductive storage devices is limited by the specific strength of available construction materials. It is difficult to expect cardinal progress in the specific strength or in the weight of those sources and devices.

A number of articles describe alternative methods of energizing electromagnetic launchers in general and railguns in particular. In recent years, significant progress was made in capacitor storage technology. This is undoubtedly the most convenient method to store electric energy. However, even the most bold forecasts for the specific energy of capacitor banks are still lower than that of inductive energy storage.

In the early 1980's, research programs studied electromagnetic launchers at the Livermore and Los Alamos National Laboratories. The programs focused on railguns energized by magnetic flux compression generators (MFCG). MFCGs are inexpensive one shot devices used as pulsed power sources to energize various loads, usually in the submillisecond range of pulse duration. The simplest strip type MFCG consists of two elongated, generally parallel strips of high conductive metal directly connected to the load. The strips may be initially shorted at one end by a switch and connected at the other end to an external pulsed electric source (a capacitor bank or another MFCG). After the external source generates a short current pulse and thus supplies the strip circuit with magnetic flux, an explosive positioned adjacent one of the strips is initiated near the power source end of the strip. A detonation wave propagates along the strip, imploding one strip onto the other. The implosion creates a traveling crowbar effect which diminishes the length and inductance of the strip line, thus compressing the magnetic flux and increasing the electric current and magnetic energy. The current in a MFCG can easily reach several megaamps.

MFCGs can be connected in series, forming a cascade, in which one MFCG section feeds the next section with magnetic flux and energy. Transformer links between the sections have been used in such cascades to increase the magnetic flux. MFCGs have been successfully used to launch projectiles in small and medium caliber railguns. Because of the short current pulse produced by the MFCG, the railgun barrels were relatively short, and projectiles were often damaged because of the high acceleration they were subjected to.

Railguns and strip line MFCGs geometrically are similar. D. R. Peterson and C. M. Fowler published a short description of the conceptual design of a hybrid railgun called an "integral railgun". D. Peterson & C. Fowler, *Rail Gun Powered by an Integral Explosive Generator*, Los Alamos Nat. Lab. Rep. LA-8000-C; See also, C. Fowler et al. *Explosive Flux Compression Generators for Rail Gun Power Sources*, IEEE Trans. Mag., Vol. 18, No. 1, pp. 64–67 (January 1981). According to the authors, metal strips or elongated plates are used as guiding and contacting rails of a conventional railgun and as conducting and imploding strips of the MFCG. Fowler and Peterson studied a hybrid railgun operation using a simplified analytical model, in which flux losses were neglected. They have shown that, ideally, such a system can be used to launch a projectile to hypervelocities.

However, Fowler and Peterson recognized potential problems inherent to the conceptual design they considered. In addition to flux losses, the design may generate harmful jets. Jets occur when the rails undergo high velocity collision at a small angle (a process somewhat similar to shaped charge implosion). The generation of hypervelocity jets in such collisions is dangerous because the jets can easily reach and destroy the projectile.

One additional potential problem not discussed by Fowler and Peterson is maintaining a gapless contact with a metal armature, or a gapless sealed bore with a plasma armature. Large magnetic pressure in the region between the armature and the rail crowbar will expand and deform the strips, creating gaps in the contact.

The above discussion shows that despite certain very enticing advantages of a hybrid railgun, the conceptual design has not been readily implemented in an effective and practical launcher. While it is desirable to integrate electric energy generation and projectile acceleration in one device, a feasible conceptual design should eliminate the above mentioned problems.

SUMMARY OF THE INVENTION

An electromagnetic railgun according to one embodiment of the present invention includes a plurality of elongated bus-bars having a bore therebetween, the bore defining a breech end and a muzzle end. A source of magnetic flux is connected to the elongated bus-bars to supply a magnetic flux around at least one of the bus-bars and within the bore to propel a launch package through the bore from the breech end toward the muzzle end. A magnetic flux compressor is positioned outside of the bore and extends along the bore to compress the magnetic flux and generate a traveling crow bar effect outside the bore to displace the magnetic flux along the bore toward the muzzle end.

In one form of the invention, the magnetic flux compressor is an elongated, tubular conductive liner which surrounds the bus-bars. The liner has an inside surface spaced from the barrel and an outside surface supporting at least one layer of explosive positioned on the outside surface and distributed along the liner. A ballast layer encloses the layer of explosive between the ballast layer and the elongated, tubular conductive liner.

According to another embodiment of the invention, the electromagnetic railgun includes a plurality of elongated bus-bars having a bore therebetween, the bore defining a breech end and a muzzle end. A magnetic flux generator is connected to the elongated bus-bars to generate a magnetic flux around at least one of the bus-bars and within the bore to propel a launch package through the bore from the breech end toward the muzzle end. A magnetic flux compressor is positioned outside of the bore and extends along the bore to compress the magnetic flux and generate a crow bar effect to displace the magnetic flux along the bore toward the muzzle end. A generator is connected to the elongated bus-bars to generate a second magnetic flux around at least one of the bus-bars, between the launch package and the muzzle end. Magnetic trappers are positioned between the elongated bus-bars and the bore to temporarily trap the second magnetic flux at selected positions along the bore. The trappers are arranged to add the second magnetic flux to the first magnetic flux as the launch package passes the selected positions to compensate for diffusive losses of the first magnetic flux.

In one form of the invention, the magnetic trappers comprise resistors distributed along the bore, wherein each resistor is positioned for electrical connection between at least one of the elongated bus-bars and the launch package as the launch package passes the resistor.

According to another embodiment of the invention, the electromagnetic railgun includes a source of pulsed current. A barrel is formed by at least one pair of elongated bus-bars spaced from one another. The barrel has a longitudinal axis and the bus-bars are connected to the source of pulsed current for conducting current in a direction parallel to the longitudinal axis. A bore structure is positioned between the bus-bars and has an elongated bore extending therethrough parallel to the longitudinal axis for slidably receiving the launch package. The bore structure has an inside surface adjacent the bore for guiding the launch package during acceleration. Contactors are connected between the bus-bars and the armature to transport current transverse to the longitudinal axis, the contactors being arranged to prevent current flow parallel to the longitudinal axis.

In one form of the invention, the contactors are positioned along the bore and are electrically isolated from one another within the bore so that each contactor is positioned within the bore to make and then break a sliding electrical contact with the armature as the armature passes adjacent each contactor through the bore. In another form of the invention, a plurality of resistors extend between the elongated bus-bars and the bore.

According to another embodiment of the invention, the electromagnetic railgun includes an armature having a leading edge and a trailing edge. A plurality of conductive bus-bars, positioned in a spaced orientation from one another, define an elongated bore which is operable for slidably receiving the armature. A magnetic flux generator is connected to the conductive bus-bars to generate a magnetic flux around at least one of the bus-bars, behind the trailing edge of the armature, to propel the armature through the bore from the breech end toward the muzzle end. A tubular, conductive shield extends along and surrounding the bus-bars at a position to instantaneously compress the magnetic flux exterior to the bus-bars to counteract magnetic forces repelling the bus-bars to thereby minimize displacements of the bus-bars.

In one form of the invention, the shield has a transverse cross section and is disposed and arranged to substantially limit deformation to circumferential stretching and minimize bending deformation.

DETAILED DESCRIPTION OF THE PREFERRED EMBODIMENTS

The present invention is an electromagnetic railgun which can accelerate projectiles with elongated metal armatures to higher velocities than that obtained by conventional railguns. The electromagnetic railgun of the present invention separates physical elements which are essential to the railgun performance into separate subsystems to perform individual functions, thereby allowing for the performance of each subsystem to be maximized. The subsystems include longitudinal current transport, transverse current transport, contacting, and guiding. The railgun of the present invention has a novel barrel structure which can be used with both conventional and explosive power sources.

1. Conventional Power Source Configuration

Figure 1:
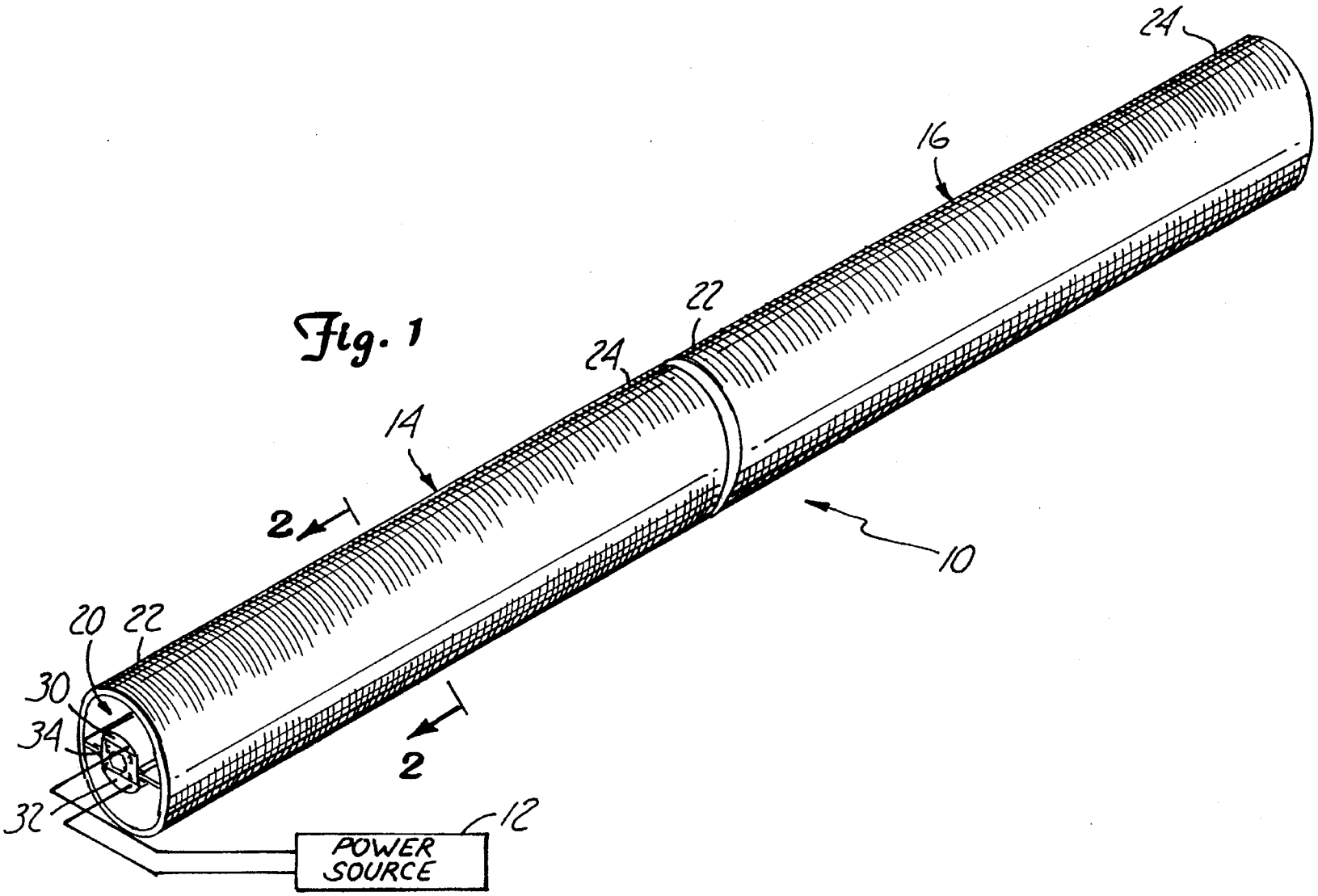
FIG. 1 is a perspective view of an electromagnetic railgun energized by a conventional power source, in accordance with a preferred embodiment of the present invention.

FIG. 1 is a perspective view of an electromagnetic railgun 10 in accordance with the present invention. Railgun 10 includes a conventional power source 12 and one or more accelerating railgun sections 14 and 16. Power source 12 can include a capacitor bank, an inductive store, or a rotating electric machine, for example. Power source 12 can include a system of individual power sources for energizing each section independently.

Each section includes a barrel 20 having a breech end 22 and a muzzle end 24. Barrel 20 accelerates a launch package (not shown) from breech end 22 toward muzzle end 24 by an electromagnetic driving force. Barrel 20 is formed by at least one pair of bus-bars 30 and 32 and a bore structure 34. Bus-bars 30 and 32 are elongated conductors which extend along barrel 20 and are operatively connected to power source 12 at breech end 22. Bus-bars 30 and 32 form the longitudinal current transport subsystem of railgun 10. Bus-bars 30 and 32 are capable of carrying enough current (thousands of kiloamperes) along barrel 20 to accelerate a massive launch package by electromotive force.

Figure 2:
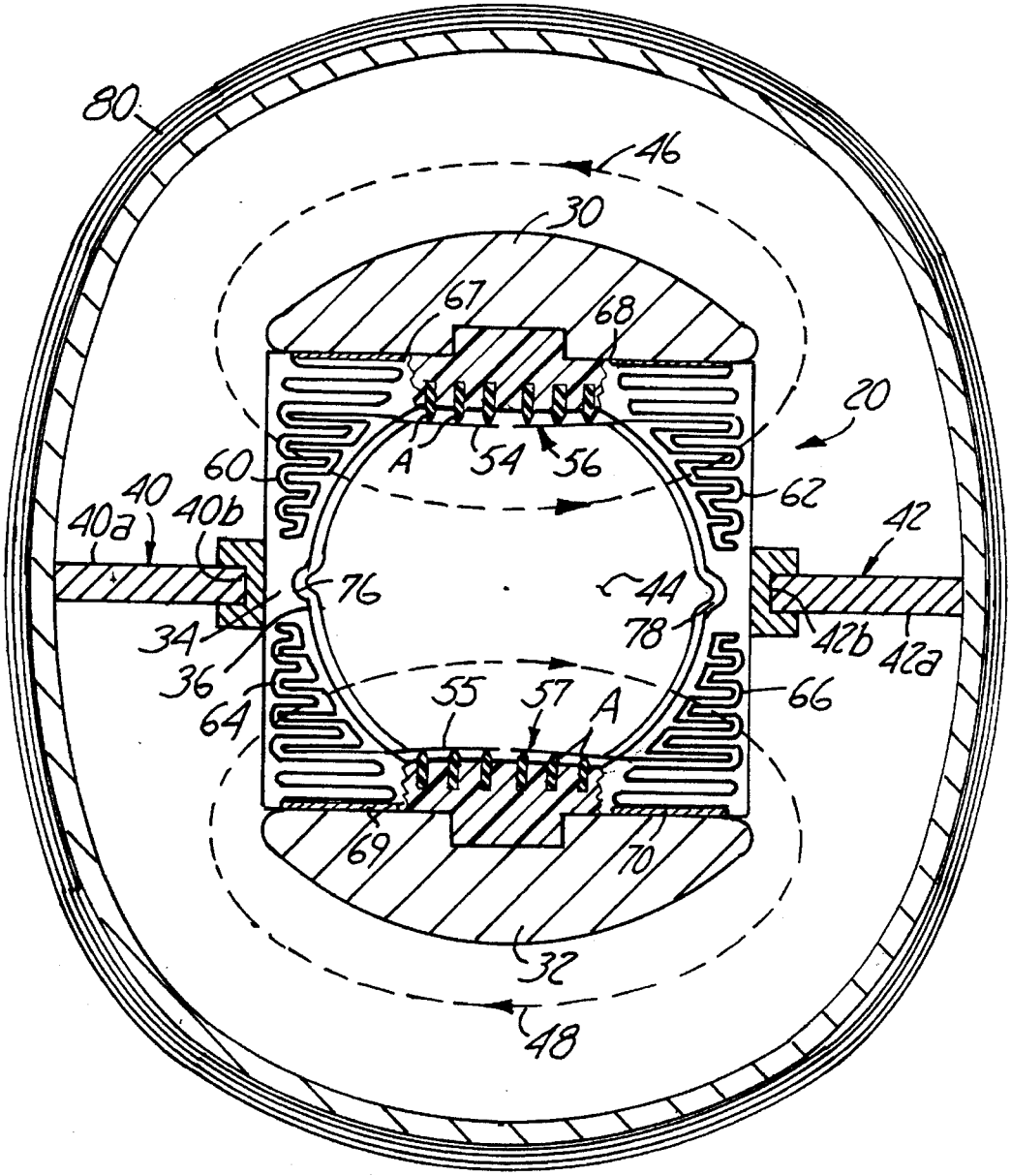
FIG. 2 is a sectional view of the electromagnetic railgun, as seen from lines 2—2 of FIG. 1.

FIG. 2 is a fragmentary sectional view of accelerating railgun section 14, as seen from line 2—2 of FIG. 1. Section 14 includes barrel 20, bus-bars 30 and 32, bore structure 34 and bore 36. For clarity, only a portion of bore structure 34 is shown hatched, to permit viewing of resistors 60,62, 64 and 66, to be described below. Tubular, conductive shield 38 surrounds barrel 20 and is supported along its length by supports 40 and 42.

An armature 44 is positioned within bore 36, between bus-bars 30 and 32. Attached to armature 44 is a payload or projectile (not shown) which is accelerated with the armature as it travels along the length of bore 36. The armature and the projectile together form the launch package. When power supply 12 supplies a current pulse to bus-bars 30 and 32, armature 44 completes a circuit forming a current path from power source 12, along bus-bar 30, through armature 44, along bus-bar 32 and back to power source 12. The current pulse flowing along bus-bars 30 and 32 generates a magnetic field around bus-bars 30 and 32, behind armature 44. The magnetic field is shown by lines 46 and 48. The magnetic field generates an electromagnetic force (jxB) which propels armature 44 along bore 36, where j is the current density and B is the magnetic flux density.

In one preferred embodiment, armature 44 is an elongated metal armature which functions both as an electric armature and as a sabot (bore rider). The projectile is located inside armature 44 so that the force accelerating the projectile is applied to its side surface, as opposed to its trailing end, to minimize stresses during acceleration. The projectile can be threadably secured within armature 44, for example. Armature 44 can be designed to be discarded. Alternatively, armature 44 can be made as an integral part of the projectile and can have shape elements which improve aerodynamic quality. Armature 44 is not required to be highly conductive since the current is distributed along the length of the armature. Therefore, resistive metals with mechanical properties sufficient to withstand large forces can be used for armature 44. Since armature 44 is accelerated by electromagnetic forces and not by gas pressure, its cross section should not fill the entire cross section of bore 36. Armature 44 is discussed in greater detail with reference to FIGS. 5 and 6.

Bore structure 34 performs the guiding function and is preferably made of an insulating material. Bore structure 44 directs the motion of armature 44 and the projectile while they are accelerated within barrel 20 and while they are transferred from one accelerating railgun section to another in a multi-sectional railgun. Bore structure 34 can be made of rigid, electrically isolating material and may have low friction coating adjacent bore 36.

Figure 3:
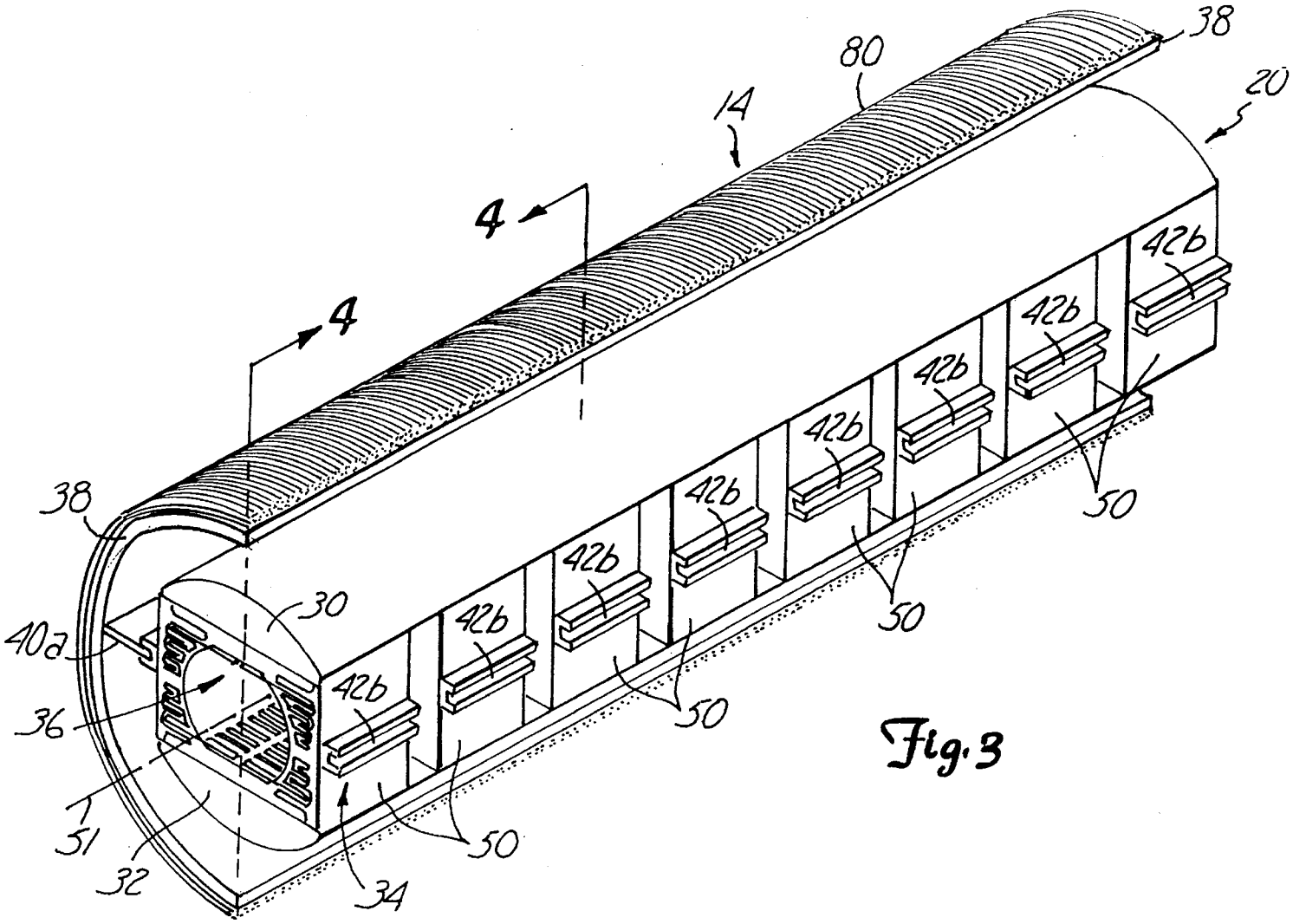
FIG. 3 is a perspective view of the electromagnetic railgun shown in FIGS. 1 and 2 with portions removed for clarity.

Bore structure 34 is shown in greater detail in FIG. 3. FIG. 3 is a perspective view of accelerating railgun section 14 with portions broken away for clarity. Bore structure 34 is preferably segmented along the length of barrel 20 into a plurality of spaced segments 50. The plurality of spaced segments 50 are aligned by rigid support beams 40*a* and 42*a*, received in slots 40*b* and 42*b*. As armature 44 travels along bore 36, the center of mass of the armature and projectile may slightly oscillate transversely, or ballot, with respect to a central axis 51 of bore 36. Balloting causes small transverse displacements of bore structure 34.

In a conventional railgun with a unitary bore structure, the displacement of the bore structure about its central axis creates elastic waves which propagate along bore 36 and accompany the motion of armature 44. The elastic waves adversely effect armature motion at armature speeds of up to about 3–5 km/s. Above 3–5 km/s the velocity of armature 44 exceeds the propagational velocity of the elastic waves. The segmented bore structure shown in FIG. 3 suppresses elastic wave propagation along bore 36 to diminish armature balloting.

In addition, the segmented bore structure reduces the stresses in bore structure 34 caused by strong electromagnetic forces acting on resistor elements (also discuss below) which are embedded into the isolating material of bore structure 34. Each bore structure segment 50 can slide slightly with respect to bus-bars 30 and 32 without effecting the position of the adjacent bore structure segments.

Referring to FIG. 2, barrel 20 further includes a plurality of contactors 54 and 55 distributed along its length and positioned within bore 36. Contactors 54 and 55 are thin strips of highly conductive metal such as copper, aluminum or a suitable alloy. In one embodiment, contactors 54 and 55 have a thickness of about 0.1–1.0 mm, which is sufficient to withstand the thermal effects of the short current pulse. As armature 44 passes individual contactors 54 and 55, the contactors are deflected and exert pressure against the armature at armature contact zones 56 and 57. The pressure is caused by the inertia of each contactor as it is deflected by armature 44 and by electromagnetic forces acting on the current carrying contactors.

The electromagnetic force acting on each contactor depends upon the direction of current in the contactor with respect to the local magnetic fields 46 and 48 created by bus-bars 30 and 32. The electromagnetic force acting on each contactor may be nulled if the volume current density (j) in the contactor is parallel to the direction of the local magnetic field. Contactors 54 and 55 are generally parallel to magnetic fields 46 and 46, respectively. Further, it is preferable to have a small component of the volume current density (j) in a direction opposite to the direction of armature motion in order to provide for a moderate contribution to the pressure between contactors 54 and 55 and armature contact zone 56.

In a preferred embodiment, contactors 54 and 55 are spaced from the inner surfaces of bus-bars 30 and 32. Contactors 54 and 55 have elastic supports A connecting them to the inner surface of bore structure 34. Contactors 54 are electrically connected to bus-bar 30 through resistors 60 and 62. Contactors 55 are electrically connected to bus-bar 32 through resistors 64 and 66. Resistors 60, 62, 64 and 66 and contactors 54 and 55 preferably do not conduct current in the longitudinal direction along bore 36. The resistors together form a resistive array to eliminate the velocity skin effect and distribute current about contact zones 56 and 57 more evenly, as opposed to allowing the current to concentrate at the trailing edge of armature 44. Resistors 60, 62, 64 and 66 are connected to bus-bars 30 and 32 through sliding metallic contacts 67, 68, 69 and 70, respectively.

Figure 4:
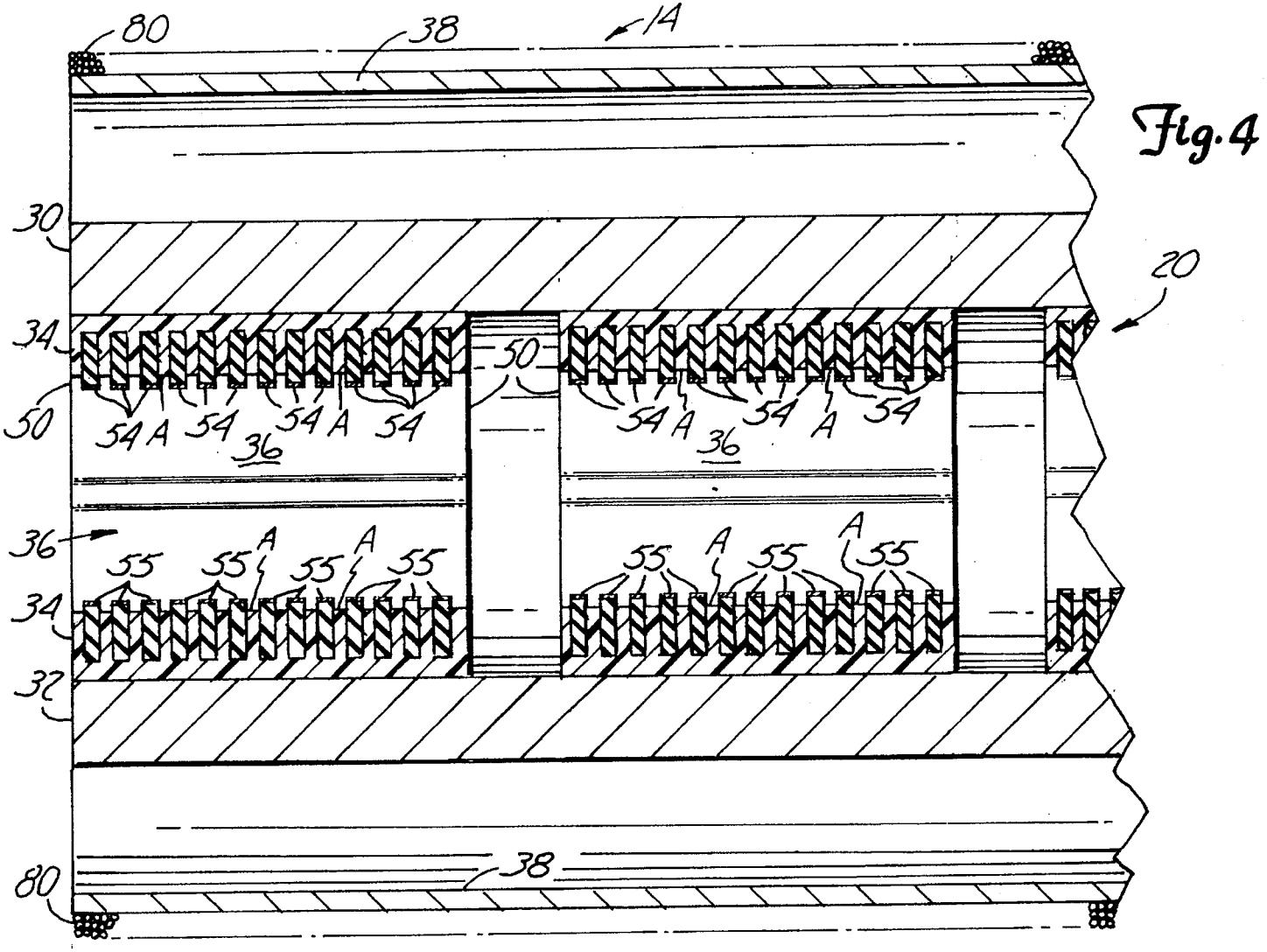
FIG. 4 is a sectional view of the electromagnetic railgun, as seen from lines 4—4 of FIG. 3.

FIG. 4 is a fragmentary sectional view of barrel 20 taken along lines 4—4 of FIG. 3. FIG. 4 illustrates the plurality of contactors 54 and 55 disposed along an inner surface of bore structure 34, adjacent bore 36. As armature 44 (not shown) passes through bore 36 of a given bore structure segment 50, the armature makes electrical contact with the adjacent contactors 54 and 55 and begins to make contact with the contactors positioned within the next adjacent bore structure segment 50.

Contactors 54 and 55, resistors 60, 62, 64 and 66 and their associated connectors form the transverse current transport subsystem between bus-bars 30 and 32 and armature 44. As shown in FIGS. 2 and 4, the transverse current transport subsystem does not conduct current in the direction of armature motion (this is the function of bus-bars 30 and 32). Thus, only bus-bars 30 and 32 are subject to strong repelling forces similar to those in conventional railguns. Small displacements of bus-bars 30 and 32 do not adversely effect electrical contact with armature 44 as long as the connectors between resistors 60, 62, 64, and 66 and contactors 54 and 55 are flexible enough or slidable to accommodate the slightly deflecting bus-bars 30 and 32. As a result, high barrel stiffness is not required. However, the barrel structure must have sufficient mechanical strength to prevent larger displacements in the structure caused by the repelling forces. A conventional shell-type barrel structure may be used to withstand the repelling forces. In alternative, a tubular conductive shield with a reinforcing winding may be used to counteract the repelling forces, as discussed below.

Resistors 60, 62, 64 and 66 can be implemented in a variety of configurations. In a preferred embodiment, each resistor consists of a thin and narrow bifilar copper or aluminum strip coated with a thin lacquer or resin for electrical isolation. The strip is then folded or lapped as shown in FIG. 2. The thickness, width and length of the strips can be chosen to provide a selected resistance which can vary in a selected manner with temperature as the current pulse passes through the strip.

The resistivity of each strip is dependent on temperature since the strips are made of highly conductive metal. Thus, it is possible to control the effective length and the profile of the current distribution and, therefore, the profile of the driving force in armature 44. The size and resistivity parameters of resistors 60, 62, 64 and 66 can also be varied along bore 36 according to the local duration of the current pulse passing through each individual resistor.

Resistors 60, 62, 64 and 66 can be connected between contactors 54 and 55 and bus-bars 30 and 32, respectively, in any convenient manner. Resistors 60, 62, 64 and 66 are connected to bus-bars 30 and 32 through sliding metallic contacts 67, 68, 69 and 70 to allow for small displacements of bore structure 34. Resistors 60, 62, 64 and 66 are preferably imbedded into electrically isolating bore structure 34. The electromagnetic/forces acting on resistors 60, 62, 64 and 66, caused by current flowing through the resistors, are largely canceled by the bifilar configuration of the resistors. However, the electrical connections between resistors 60, 62, 64 and 66, contactors 54 and 56, and bus-bars 30 and 32 transport a generally unidirectional current in the induced magnetic field surrounding bus-bars 30 and 32. Therefore, the electrical connections are subject to strong electromagnetic forces and should be imbedded into bore structure 34.

The parameters for the resistive array are preferably chosen to satisfy three principal requirements. First, the resistivity should be large enough to distribute current over most of the length of contact zones 56 and 57. Second, the thermal capacity of resistors 60, 62, 64 and 66 should be large enough to avoid superheating due to resistive losses. Third, the resistivity should increase with temperature to distribute the electromagnetic forces more evenly.

2. Selection Of Resistivity

As mentioned above, the resistivity of the resistive array should be large enough to distribute current over the entire length of contact zones 56 and 57. Magnetic fields 46 and 48, established between bus-bars 30 and 32 by the initial current pulse, penetrate bus-bars 30 and 32 and armature 44 due to magnetic diffusion in a direction transverse to central axis z of bore 36. The time for armature 44 to pass a given point along bore 36 is $t_p$ 32 $l_a/v$, where 1, is the length of armature 44 and v is the velocity of the armature. For example, assume that the gaps between armature 44 and the surfaces of bus-bars 30 and 32 exceed the transient skin depth of the magnetic diffusion into the bus-bars during time $t_p$. In order for the magnetic field to penetrate the gap, the resistive array should dissipate the amount of magnetic energy in the gap. The magnetic energy E of the magnetic field penetrating the gap is:

$$PE - Lg\ I_a/21\ a \qquad \text{Equation 1}$$

Where:

Lg =the inductance gradient of an electric line consisting of ideally conducting bus-bars and an ideally conducting cylindrical insertion with the same cross-section as that of armature 44;

I=current through the bus-bars; and $I_a$=length of armature 44.

The resistive array formed by resistors 60, 62, 64 and 66 has a resistivity of:

$$R_r=R/n\ (\text{Ohm}*m) \qquad \text{Equation 2}$$

Where:

$R_r$=resistance of unit length of the resistive array;

R=resistance of each resistor in the array; and n=the number of resistors per unit length in the resistive array.

Each resistor conducts current only during the time $t_p$ when armature 44 is passing by. The resistance of a segment of the resistive array with a length $l_a$ is $R_r/l_a$. Therefore, the resistivity $R_r$ of the resistive array can be estimated from:

$$(R_r/l_a)*t_p*I^2=(L_gI^2/2)\ l_a \qquad \text{Equation 3}$$

Then:

$$R_r=L_g*l_a*v \qquad \text{Equation 4}$$

Further, the resistive array may have a resistance that increases from breech end 22 to muzzle end 24. In one embodiment, the resistance is increased by increasing the number of folds in successive resistor strips along the length of barrel 20. Alternatively, the resistance can be varied by employing a material with increasing resistivity toward the muzzle end. In either case, it is preferred that the resistor thickness not affect the spacing between armature 44 and bus-bars 30 and 32. The resistance is selected to match the speed of magnetic field diffusion with the speed of armature 44.

3. Armature

Figure 5:
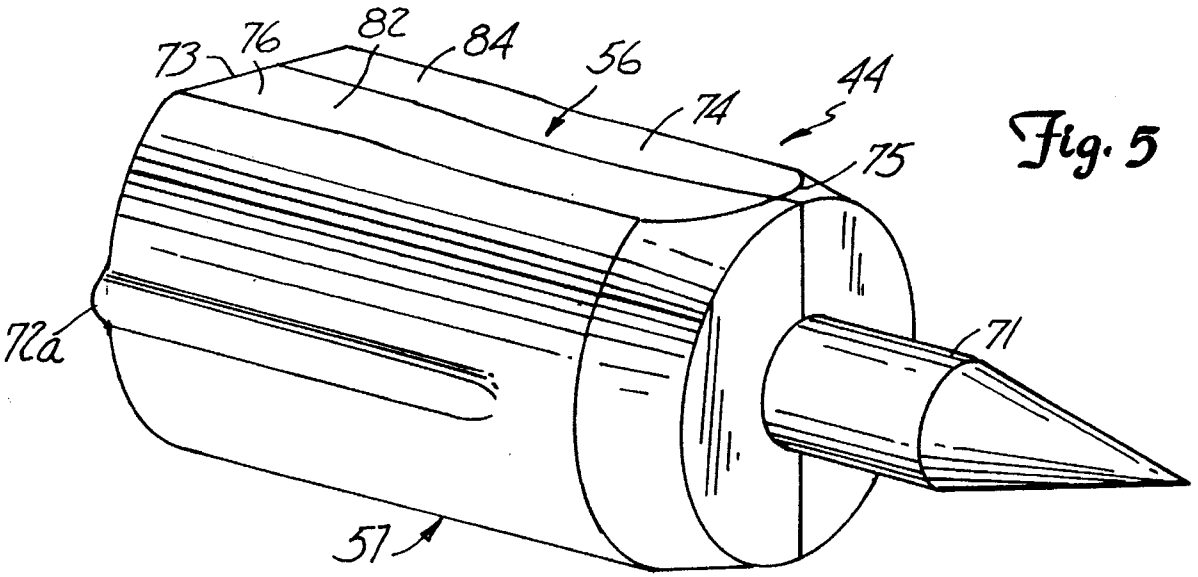
FIG. 5 is a perspective view of a launch package, in accordance with a preferred embodiment of the present invention.
Figure 6:
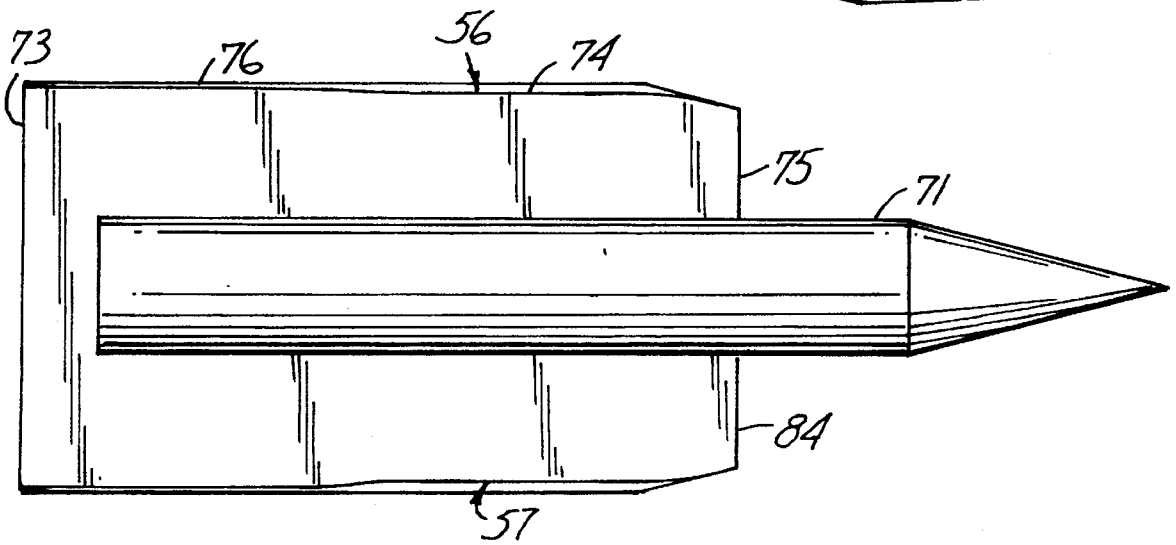
FIG. 6 is a side view of the launch package, with a portion of an armature removed.

FIG. 5 is a perspective view of armature 44, with attached projectile 71. FIG. 6 is a side view of armature 44, with a portion of the armature removed. Armature 44 includes contact zones 56 and 57 and raised guiding fins 72 (*a*) and 72 (*b*) (72 (*b*) not shown). Guiding fins 72 (*a*) and 72 (*b*) mate with grooves 76 and 78 (shown in FIG. 2) within bore structure 34 to guide armature 44 along bore 36 and to prevent armature 44 from rotating. In alternative embodiments, armature 44 and bore 36 can have oval or rectangular geometries which inherently prevent rotation.

Armature 44 is formed by symmetric portions 82 and 84 which close over a trailing portion of projectile 71. This configuration facilitates separation of portions 82 and 84 once armature 44 leaves the muzzle end of railgun 10 to free projectile 71. Projectile 71 is shown in FIGS. 5 and 6 as a rod-like penetrator.

Armature contact zones 56 and 57 have a slightly tapered curvilinear surface 74 extending from trailing edge 73 toward leading edge 75, in the direction of armature motion. Contactors 54 and 55 first touch armature 44 at leading edge 75 where contact zones 56 and 57 are nearly parallel to the direction of armature motion. Contactors 54 and 55 then slide along contact zones 56 and 57, respectively, and exert some pressure on the contact zones due to a concave curvature on curvilinear surface 74.

When contactors 54 and 55 slide past leading edge 75, the current in the contactors may be small, so that the pressure between contactors 54 and 55 and armature 44 is initially provided from the contactor's inertia. As contactors 54 and 55 slide toward trailing edge 73, the current through the contactors increases causing the electromagnetic force on the contactors to increase. The electromagnetic force becomes the main source of pressure between contactors 54 and 55 and contact zones 56 and 57, respectively, so that the curvature near trailing edge 73 may be reversed at 76.

The geometry of contactors 54 and 55 can be chosen to maintain the pressure between the contactors and armature 44 at several percent of the magnetic pressure behind the armature. Thus, the magnetic pressure accelerating armature 44 may be hundreds or thousands Megapascals (MPa), while the pressure at sliding contact zones 56 and 57 is much lower. This greatly reduces the possibility of gouging.

In one preferred embodiment, contact zones 56 and 57 have a taper of about 0.5–3.0 mm from leading edge 75 to trailing edge 73 over about 30 cm. In this range, the displacement of contactors 54 and 55 is large enough that small transverse oscillations of armature 44 due to balloting in bore 36 do not appreciably influence the quality of the sliding contact. The design parameters of contactors 54 and 55 can be varied along the length of bore 36 according to the local armature velocity.

4. Conductive Shield

As shown in FIGS. 2, 3 and 4, accelerating railgun section 14 includes tubular conductive shield 38 and reinforcing winding 80. Shield 38 and winding 80 extend along the entire length of barrel 20 to provide structural and magnetic support for barrel 20. Since high conductivity materials serve as a screen for pulsed magnetic fields, they also may be used to influence the magnetic field distribution. Shield 38 compensates for repelling forces caused by magnetic interactions of currents in bus-bars 30 and 32, if the distance between the bus-bars and tubular conductive shield 38 is chosen properly. In one embodiment, the spacing between the outside surfaces of bus-bars 30 and 32 and the inside surface of shield 38 is about 0.4 of the spacing between the bus-bars.

The interaction between the current in bus-bars 30 and 32 and an induced current in tubular conducting shield 38 creates an inward electromagnetic force on bus-bars 30 and 32 which compensates, or initially overcompensates, for the outward, repelling forces on the bus-bars. The degree of compensation is determined by the ratio of the skin effect depth of shield 38 and the distance between bus-bars 30 and 32. During the time typically required for armature 44 to pass a given point along bus-bars 30 and 32, the skin effect depth is less than 1 mm (i.e., the armature is typically moving at several km/s). Thus, displacements of bus-bars 30 and 32 in contact zones 56 and 57 can be reduced by a factor of 10 to 100 for railguns with a bore size in the centimeter range.

The shape of tubular conducting shield 38 should be chosen such that its main deformation will be circumferential stretching, as opposed to flexing or bending deformation. An appropriately chosen oval or elliptical shape will completely compensate for repulsion between bus-bars 30 and 32 so that the bus-bars and shield 38 will be in mechanical equilibrium and the shield will experience only stretching deformation. A shield having a circular shape will experience both stretching and flexing deformation. If shield 38 is slightly undersized compared to that needed to compensate for repelling forces between bus-bars 30 and 32, then the inward electromagnetic forces created by shield 38 will prevail over the repelling forces. The net inward electromagnetic force on barrel 20 can be effectively counterbalanced by an elastic interaction with compressed bore structure 34.

The skin effect depth (magnetic field penetration) in bus-bars 30 and 32 and in shield 38 increases over time causing the inward forces acting on the bus-bars to decrease. This results in a slow evolution of the mechanical equilibrium of shield 38 and bus-bars 30 and 32, so that the distance between the bus-bars will slowly increase. However, an added benefit of shield 38 is that the screening effect causes any bending deformations of bus-bars 30 and 32 to have longer wave lengths. Thus, the propagation of the bending deformations along bus-bars 30 and 32 is much slower so that they cannot overtake armature 44. This is a favorable benefit since the propagation of such elastic deformations ahead of armature 44 and possible resonant effects of their interaction with armature 44 are highly undesirable.

The railgun design described with reference to FIGS. 1–6 provides a significant improvement to prior railguns in certain critical aspects, including arching transition, gouging, and balloting, which are known as the principal impediments to achieving higher projectile velocities. The design provides several specialized subsystems which separately perform the functions traditionally performed by rails in a conventional railgun. These functions include longitudinal current transport, transverse current transport, contacting, and projectile guiding.

At the same time, other important characteristics of railguns are not expected to change with the above-described design of the present invention. These characteristics include efficiency and weight-to-energy ratio. Efficiency is the ratio of the final kinetic energy of the projectile to the electric energy supplied by power source 12. Efficiency may actually decrease slightly with the increased distance between the armature contact surface and bus-bars 30 and 32 because a larger part of the electric energy will be dissipated in the resistive array formed by resistors 60, 62, 64 and 66. The weight-to-energy ratio is the ratio of the railgun weight to the projectile energy. This ratio is not expected to change greatly with the abovedescribed design of the present invention.

5. Self-Energized Railgun

Another aspect of the present invention provides a mechanism for converting energy which is distributed along the bore into an electromagnetic driving force and, finally, into kinetic energy of armature 44. The energy to be converted can include thermal, chemical and mechanical energy.

Figure 7:
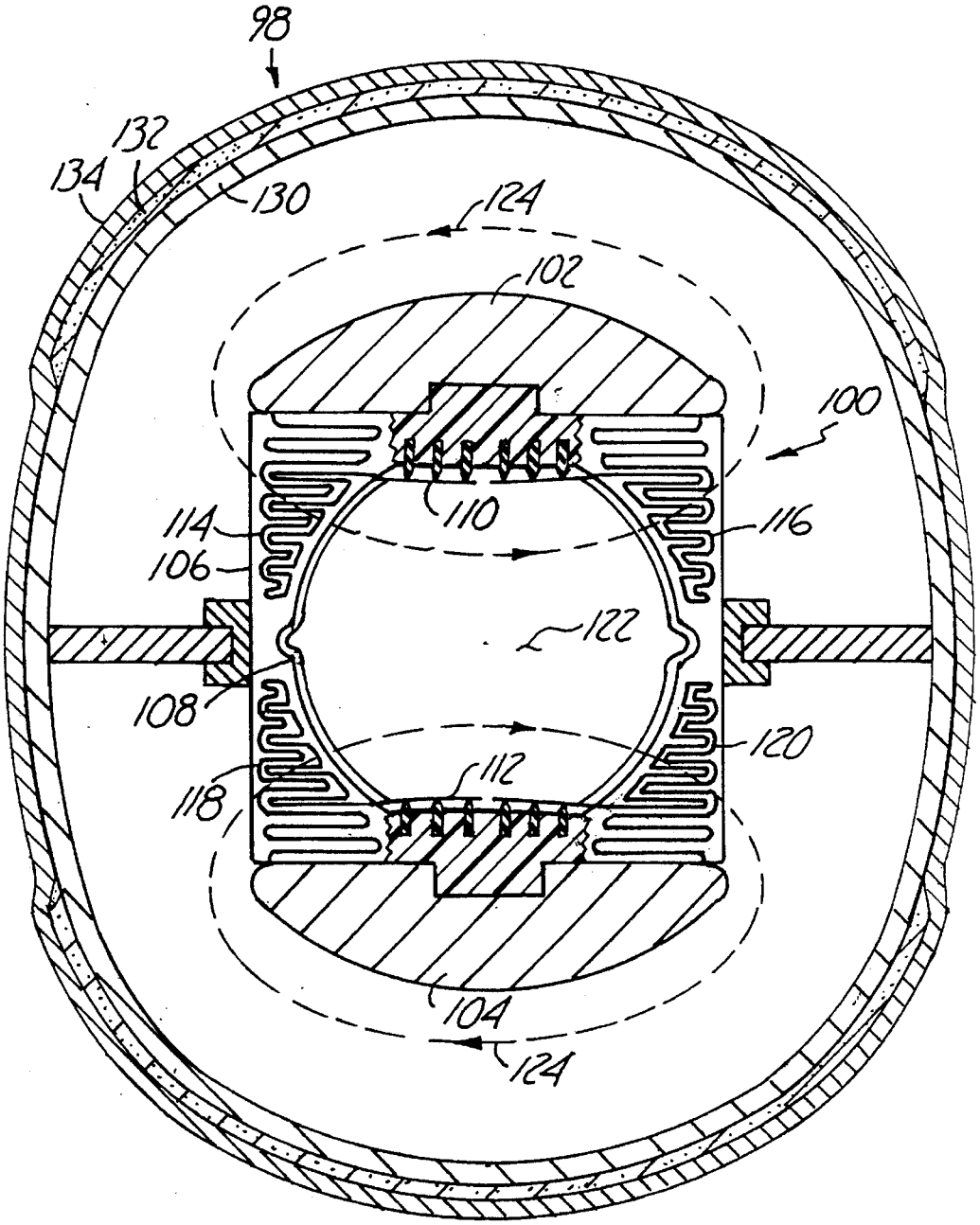
FIG. 7 is a sectional view of a self-energized electromagnetic railgun, in accordance with another preferred embodiment of the present invention.

FIG. 7 is a fragmentary sectional view, as in FIG. 2, of a self-energized electromagnetic railgun 98 in accordance with the present invention. Railgun 98 includes a barrel 100 which is substantially similar to barrel 20, shown in FIGS. 1–4. Barrel 100 is formed by bus-bars 102 and 104, bore structure 106, bore 108, contactors 110 and 112, and a resistive array formed by resistors 114, 116, 118 and 120. Armature 122 travels through bore 108 in response to a magnetic field 124 which is generated by bus-bars 102 and 104.

Railgun 98 further includes conductive liner 130, explosive layers 132 and 133 and ballast layer 134, which surround barrel 100. Explosive layers 132 and 133 are distributed on an exterior surface of liner 130 and extend along bus-bars 102 and 104, respectively. Ballast layer 134 is preferably formed from a material that is heavier than liner 130 to provide inertial ballasting to implode liner 130. Liner 130 is imploded by a detonation wave propagating forward along explosive layers 132 and 133. In one embodiment, explosive layers 132 and 133 are initiated synchronously with the armature motion by an array of electric fuses (not shown). The fuses can be energized inductively by the front of the traveling wave of magnetic field behind the armature. With this embodiment, it is easy to provide for a necessary delay between the wave front and initiation. In another embodiment, a pressure sensitive primary explosive is positioned on the external surface of liner 130 which is directly detonated by a step-like wave of magnetic pressure traveling behind armature 122.

Figure 8:
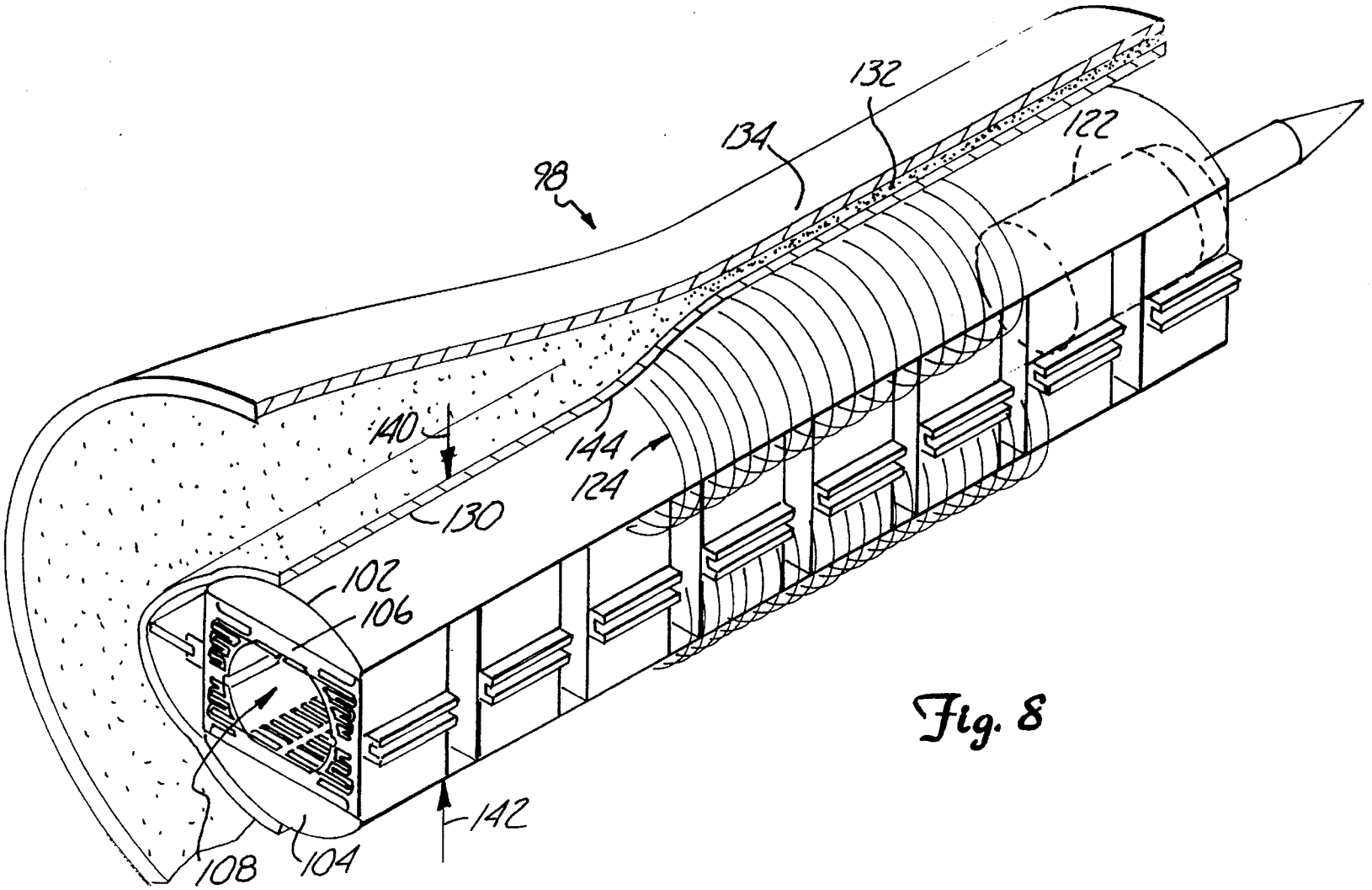
FIG. 8 is a perspective view of the self-energized electromagnetic railgun shown in FIG. 7, which illustrates the railgun in operation.

FIG. 8 is a perspective view of railgun 98 with portions removed for clarity. FIG. 8 illustrates railgun 98 in operation. As explosive layers 132 and 133 are initiated, liner 130 is imploded toward bus-bars 102 and 104, as shown by arrows 140 and 142. A detonation wave travels forward along layers 132 and 133. In an preferred embodiment, conductive liner 130 is a metal, tubular shield enclosing barrel 100, similar to shield 38 discussed with reference to FIGS. 2–4. Conductive liner (shield) 130 counterbalances the repulsion forces acting on bus-bars 102 and 104. The imploding liner 130 decelerates by performing work against magnetic pressure, diminishing the local inductance gradient and displacing magnetic flux 124 toward armature 122. Conductive liner 130 then contacts bus-bars 102 and 104 at position 144 creating a traveling "crow bar" effect. The crow bar effect compresses magnetic flux 124 and displaces the magnetic flux forward toward armature 122 to create a large electromagnetic force which accelerates armature 122.

In self-energized (explosive) railguns of the prior art, the conductive rails themselves undergo the implosion, so that the contact surfaces of the rails which serve for guiding the projectile are displaced inwardly to create the crow bar effect. This inevitably results in the complete destruction of the railgun after a single use. In contrast, the self-energized railgun of the present invention implodes a metal conductor (conductive liner 130) outside the railgun bore 108. If the implosion is designed to be consistent with armature acceleration, conductive liner 130 losses nearly all of its energy to perform work against magnetic pressure. Therefore, the strength of its collision with bus-bars 102 and 104 can be essentially reduced so that barrel 100, consisting of rails 102 and 104, bore structure 106, and bore 108, can be reused for subsequent launches.

Figure 8A:
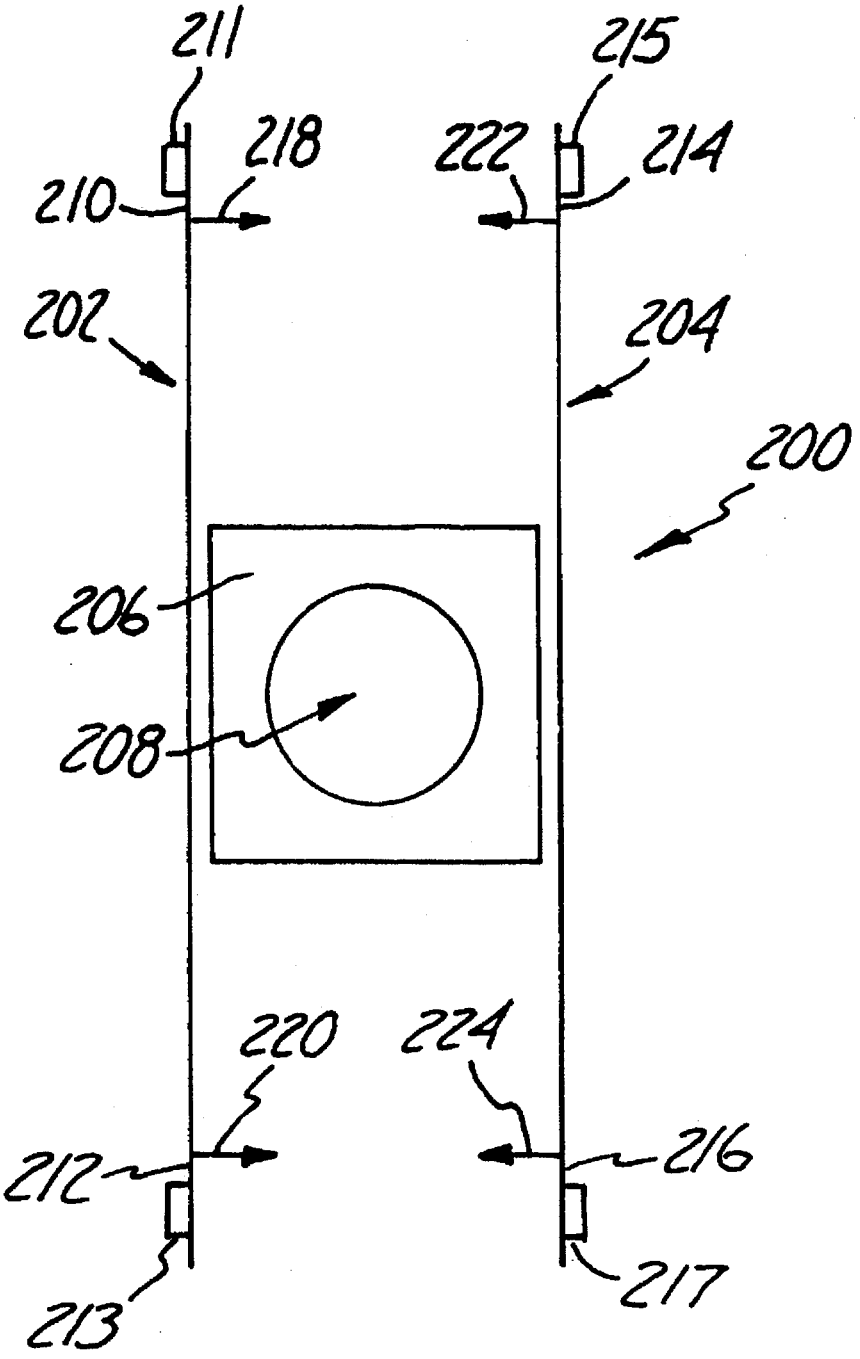
FIG. 8A is a schematic illustration of a modification of a self-energized electromagnetic railgun.

In another embodiment, the sides of a pair of relatively wide bus-bars can be accelerated toward one another to create the crow bar effect outside the bole. FIG. 8A is a schematic illustration of railgun 200, as viewed from the breech end. Railgun 200 includes relatively wide bus-bars 202 and 204, bore structure 206 and bore 208. Bus-bar 202 has edge portions 210 and 212 carrying explosives 211 and 213 on an outside surface thereof. Bus-bar 204 has edge portions 214 and 216 carrying explosives 215 and 217 on an outside surface thereof. Edge portions 210 and 212 of bus-bar 202 and edge portions 214 and 216 of bus-bar 204 are imploded toward one another by the explosives in the direction of arrows 218, 220, 222 and 224 to create a crow bar effect outside bore 208.

6. Example

The muzzle kinetic energy of a launch package is less than the chemical energy of explosive layer 132 by a factor of $\eta_r\eta_i$, where $\eta_r$ is the combined efficiency of the flux compression and armature acceleration in self-energized railgun 98 and where $\eta_i$ is the efficiency of the liner implosion. Contrary to a conventional railgun, no magnetic energy is left, ideally, in railgun bore 108 after magnetic flux 124 is compressed and displaced. Therefore, $\eta_r$ can be greater than 0.5. The magnitude of 72 $_r$ depends upon flux losses and related energy losses in the flux compensation process. Flux losses and energy losses become less important as the transverse dimensions of the railgun increase. The efficiency of implosion of conductive liner 130 can be as high as 0.2–0.3. The overall efficiency can therefore be on the order of 0.1–0.2.

Based on numerical modeling, a 250–500 kg explosive with a 5 MJ/kg specific energy is required to accelerate a 5 kg launch package to 10 km/s (muzzle energy of 250 MJ). Assuming that it is possible to accelerate a launch package with an average acceleration of $10^6$ m/s$^2$, the length of barrel 100 would be about 50 m. If the bore diameter is 100 mm and the barrel diameter is 200 mm (the barrel consists of the bore structure and two bus-bars), the explosive would be distributed over the exterior surface of the liner with an average density of 0.7–1.5 g/sm$^2$. With this average density, the explosive should be capable of accelerating a 1 mm thick copper liner or a 3 mm thick aluminum liner to a velocity of 1.5–2.0 km/s. With an electric current of 6–8 MA, the resulting magnetic field is approximately 20–25 T.

7. Flux Loss Compensation

The railgun of the present invention allows for flux loss compensation. Diffusive penetration of magnetic field 124 into the surrounding metal conductors results in magnetic flux losses. Flux losses decrease the magnetic flux available for compression. Flux losses are less important for larger caliber railgun. However, flux losses may be a serious obstacle to increasing the length of the railgun and the kinetic energy of the launch package for self-energized railguns of moderate caliber, which are acceptable for experimentation.

To minimize magnetic flux losses, the walls of conductive liner 130 should be thicker than the depth of magnetic field penetration (skin depth ) during the time armature 122 and the traveling crow bar pass a given point along the liner. Magnetic pressure can be maintained constant despite flux losses by shortening the distance between armature 122 and the traveling crow bar (position 144). However, this distance should not be much less then the armature length. At some point in operation, the flux losses become too great to be compensated by shortening the distance between the armature and the crow bar, resulting in a reduction of armature acceleration.

Figure 9:
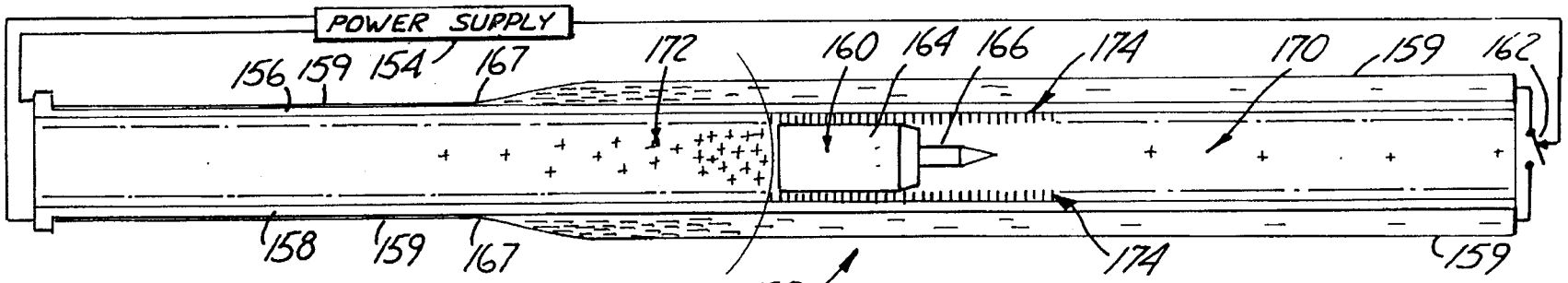
FIG. 9 is a diagrammatic view of the self-energized electromagnetic railgun shown in FIGS. 7 and 8, which illustrates flux loss compensation.

In the electromagnetic railgun of the present invention, magnetic flux losses are compensated by two methods. FIG. 9 is a diagram illustrating the first method of flux loss compensation. Electromagnetic railgun 150 includes power supply 154, bus-bars 156 and 158, liner 159, launch package 160, and switch 162. Launch package 160 includes armature 164 and projectile 166. Power supply 154 includes all necessary circuitry to generate current pulses for bus-bars 156 and 158 and to operate switch 162. Power supply 154 is connected to bus-bars 156 and 158 and to switch 162.

The first method of flux loss compensation provides a continuous supply of additional magnetic flux to the magnetic flux compressed between crow bar 167 and armature 164. The additional magnetic flux is supplied by creating a relatively weak magnetic field 170 in front of armature 164. Magnetic field 170 can be approximately ⅓ to ⅙ of the compressed magnetic field 172 behind armature 164. Magnetic field 170 is created during an initial phase of the current pulse by electrically shorting bus-bars 156 and 158 at the muzzle end with switch 162 before armature 164 contacts the bus-bars.

Due to resistive array 174, a portion of magnetic flux 170 is trapped in the gaps between successive resistors in the resistor array, bus-bars 156 and 158 and armature 164 and remains in the gaps while armature 164 passes by. The resistive array serves as a pump of magnetic flux, supplying additional flux into the crow bar/armature circuit as armature 164 passes individual resistors in the resistive array. Resistive array 174 "pumps" magnetic flux into the magnetic circuit behind armature 164 to compensate for diffusive flux losses by adding flux to the crow bar/armature circuit.

The rate of the incoming magnetic flux can be estimated as $L_g$*v* $I_m$, where $L_g$ is the inductance gradient associated with the gaps between armature 164 and bus-bars 156 and 158, v is the velocity of armature 164, and $I_m$ is the electric current in the muzzle portion of the railgun ahead of armature 164. The reverse, outgoing magnetic flux is weak if the resistance of the resistive array is chosen properly. Thus, the resistive array serves as a pump of magnetic flux in addition to a current distribution along the contact zone of the elongated armature 164. The resistive array does not increase flux losses during the crow bar, because the flux losses are due to the magnetic field trapped in the narrow skin layers of the colliding surfaces of bus-bars 156 and 158 and liner 159.

As armature 164 travels into the bore and closes the circuit between the contactors near the breach end of the bore, the remaining portion of the current pulse increases magnetic field 172 behind armature 164. An additional increase of magnetic field occurs when the crow bar wave starts to compress the magnetic flux behind armature 164.

In an alternative embodiment, magnetic field 170 in front of armature 164 is created by a relatively small electric power source connected to the muzzle. In another alternative embodiment, an array of even smaller electric power sources can be distributed along the bore. The small electric power sources supply the muzzle portion of the railgun with the additional magnetic flux when it becomes necessary to compensate the crow bar/armature circuit for the loss of magnetic flux. The above-described method of flux loss compensation is only possible in railguns having a resistive array between the bus-bars and the armature which are separated by a relatively thick gap.

Figure 10:
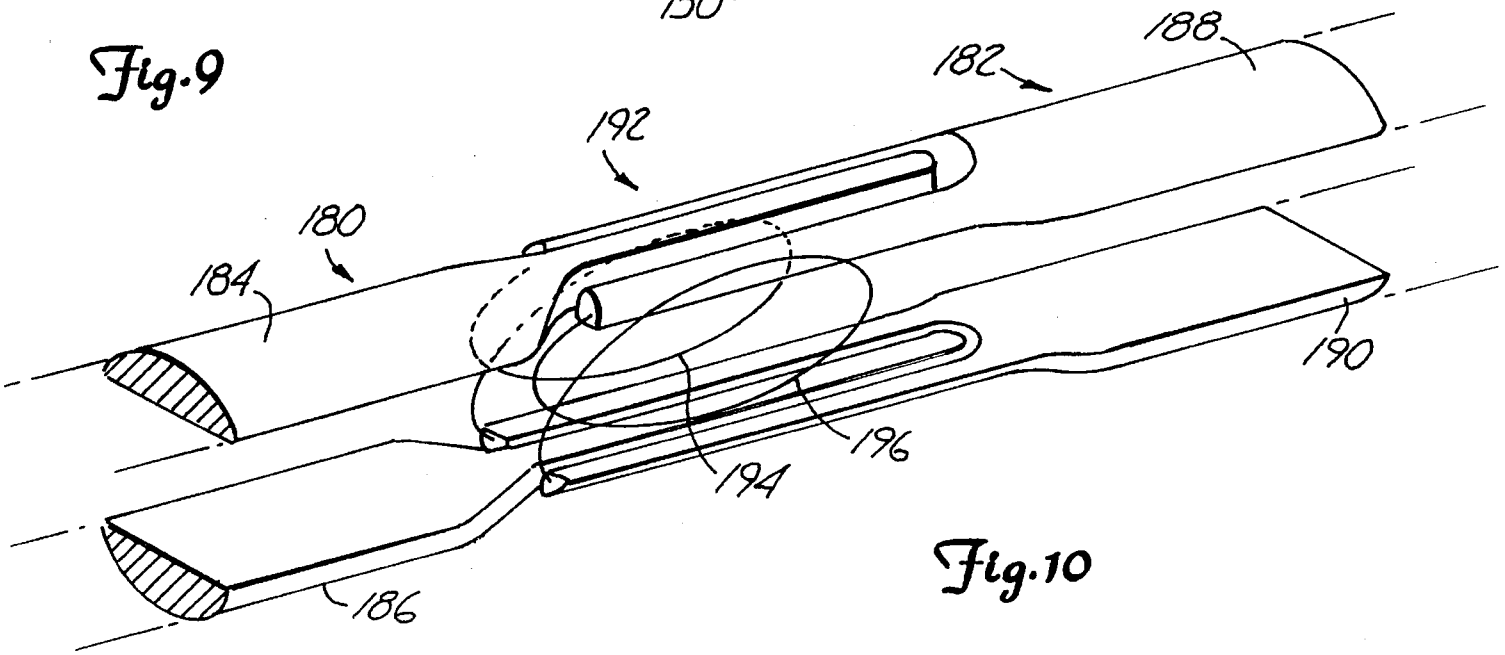
FIG. 10 is a perspective view of a transformer link between two cascaded electromagnetic railguns, in accordance with a preferred embodiment of the present invention.

The second method of flux loss compensation is illustrated in FIG. 10. FIG. 10 is a perspective view of cascaded accelerating railgun sections 180 and 182. Accelerating railgun section 180 includes bus-bars 184 and 186. Accelerating railgun section 182 includes bus-bars 188 and 190. Although only two sections are shown in FIG. 10, the electromagnetic railgun of the present invention can include a plurality of accelerating railgun sections cascaded together in the manner discussed below.

Each accelerating railgun section supplies an increased amount of magnetic flux to the next section by transforming the magnetic flux between the two consecutive railguns sections. The magnetic flux is multiplied by transformer link 192. The muzzle end of section 180 serves as a primary turn of transformer link 192. Coils 194 and 196 are connected between bus-bars 188 and 190 of accelerating railgun section 182. Coils 194 and 196 serve as the secondary turn of transformer link 192 and have good inductive linkage with bus-bars 184 and 186. Before the armature (not shown) leaves section 180 and enters section 182, a secondary circuit, formed by bus-bars 188 and 190 and coils 194 and 196 remains open and the magnetic flux freely penetrates through the turns of coils 194 and 196. When the armature contacts bus-bars 188 and 190 and then loses contact with bus-bars 184 and 186, the primary side of transformer link 192 is switched off and the multiplied magnetic flux is trapped by the secondary circuit. The magnetic flux is initially trapped in coils 194 and 196. As the armature travels further along section 182, the trapped magnetic flux supplies current and magnetic energy to section 182. The current and magnetic energy diminish during this process, but can be readily enhanced by the next phase of magnetic compression within section 182.

8. Conclusion

The present invention improves railgun design and operation making it possible to accelerate projectiles with elongated metal armatures to high velocities. The present invention avoids known complications resulting from arcing and gouging during the launch by stabilizing the electromechanical sliding contact and maintaining moderate and stable contact pressure. The present invention distributes electric current over an elongated contact zone, thus decreasing the maximum current density at the contact, reducing the danger of gouging, and distributing the driving electromagnetic force more uniformly over the elongated armature. This diminishes the mechanical stresses in the armature and stabilizes its motion in the bore.

The present invention accomplishes these improvements by simple and readily available means. Instead of the generally parallel stiff metal rails of conventional railguns which serve as both guiding rails and as a conductor transporting the current from the power source to the armature, the present invention provides a novel railgun concept in which various functions are divided among four separate subsystems. Functionally, they are called longitudinal current transport, transverse current transport, contacting and guiding subsystems. The design and properties of each of the subsystems can be chosen to optimally serve its function.

The present invention also provides a self-energizing railgun which allows for significant reduction in electric energy required from the power source. Electric energy is produced by conversion of chemical energy of an explosive or propellant distributed along the barrel. The electric energy is used for accelerating the projectile nearly immediately after it is generated. However, an external power source is still needed to supply a moderate amount of electric energy for excitation of the self-energized railgun.

The self-energized railgun design of the present invention is based upon a mechanism of converting energy into the kinetic energy of the projectile, distinct from those used in conventional artillery and in rocket propulsion. The mechanism is similar to particle acceleration by a synchronized traveling wave. Only a small amount of the projectile final energy is stored in the system at any given moment in any form other than the chemical energy of the explosive/propellant or the kinetic energy of the projectile. The self-energized railgun can be a multi-shot device with few disposable parts. For certain applications, in particular for certain military applications in which weight considerations are of particular importance, the self-energized railgun can be advantageously designed and used as a relatively inexpensive one shot device.

Although the present invention has been described with reference to preferred embodiments, workers skilled in the art will recognize that changes may be made in form and detail without departing from the spirit and scope of the invention. Instead of compressing the magnetic flux of the railgun with an imploding liner, other devices and means may be used to achieve the same function, especially with railguns having a larger caliber.

For example, a series of pistons may be distributed along the barrel to accelerate a conductive liner toward the barrel.

What is claimed is:

1. An electromagnetic railgun comprising:

a plurality of elongated bus-bars having a bore therebetween, wherein the bore has a breech end and a muzzle end;

means connected to the elongated bus-bars, for generating a magnetic flux that passes around at least one of the bus-bars and through the bore for propelling a launch package through the bore from the breech end toward the muzzle end; and means, positioned outside of and extending along the bore, for compressing the magnetic flux and generating a traveling crow bar effect outside the bore to displace the magnetic flux along the bore toward the muzzle end, without substantial deformation of the bore.

2. The electromagnetic railgun of claim 1 wherein the means for compressing and generating comprises:

an elongated, tubular conductive liner which surrounds the bus-bars, wherein the liner has an inside surface and an outside surface, with the inside surface being spaced from the bus-bars; and at least one layer of explosive positioned on the outside surface of the elongated, tubular conductive liner and distributed along the liner.

3. The electromagnetic railgun of claim 1 wherein the means for compressing and generating comprises:

an elongated conductive liner which surrounds the bus-bars, wherein the liner has an inside surface and an outside surface, with the inside surface being spaced from the bus-bars; and means positioned on the outside surface of the elongated conductive liner and distributed along the liner, for imploding the liner.

4. The electromagnetic railgun of claim 1 wherein the elongated bus-bars include edge portions extending away from the bore and the means for compressing the magnetic flux and generating a crow bar effect outside of the bore includes means for imploding the edge portions.

5. The electromagnetic railgun of claim 4 wherein the means for imploding the edge portions are attached to an outside surface of the edge portions.

6. The electromagnetic railgun of claim 1 including a transverse current transport means connected between at least one of the bus-bars and the launch package, for transporting current in a direction transverse to a longitudinal axis of the bore from one of the bus-bars to the launch package and from the launch package to another of the bus-bars and for preventing current flow through the transverse current transport means in a direction parallel to the longitudinal axis.

7. The electromagnetic railgun of claim 6, wherein the transverse current transport means comprises a plurality of resistors extending between the plurality of elongated bus-bars and the bore.

8. The electromagnetic railgun of claim 7, wherein the plurality of resistors comprises of a plurality of narrow strips of conductive material.

9. The electromagnetic railgun of claim 8, wherein the plurality of strips of conductive material are oriented in a bifilar configuration.

10. The electromagnetic railgun of claim 8, wherein the plurality of strips of conductive material are coated with the nonconductive material.

11. The electromagnetic railgun of claim 7, wherein each resistor is positioned within the bore to make and then break an electrical contact with the launch package as the launch package passes adjacent each resistor through the bore.

12. The electromagnetic railgun of claim 7, wherein the resistance of successive resistors forming the plurality of resistors increases along the path of the launch package.

13. The electromagnetic railgun of claim 6, wherein the transverse current transport means comprises a plurality of contactors positioned along the bore and are electrically isolated from one another within the bore, each contactor being positioned within the bore to make and then break a sliding electrical contact with the launch package as the launch package passes adjacent each contactor through the bore.

14. The electromagnetic railgun of claim 1, including a tubular conductive shield extending along and surrounding the bus-bars to instantaneously compress the magnetic flux exterior to the bus-bars to counteract magnetic forces repelling the bus-bars to thereby minimize displacement of the bus-bars.

15. The electromagnetic railgun of claim 14, wherein the tubular conductive shield has a transverse cross section so disposed and arranged to substantially limit deformation to circumferential stretching and minimize bending deformation.

16. An electromagnetic railgun comprising:

a plurality of elongated bus-bars having a bore therebetween, wherein the bore has a breech end and a muzzle end;

means, connected to the elongated bus-bars, for generating a first magnetic flux around at least one of the bus-bars, between the breech end and a launch package, for propelling the launch package through the bore from the breech end toward the muzzle end;

means, positioned along the bore, for compressing the first magnetic flux and generating a traveling crow bar to displace the magnetic flux along the bore toward the muzzle end;

means, connected to the plurality of elongated bus-bars, for generating a second magnetic flux around at least one of the bus-bars, between the launch package and the muzzle end; and means, positioned between the plurality of elongated bus-bars and the bore, for temporarily trapping the second magnetic flux at selected positions along the bore and arranged to add the second magnetic flux to the first magnetic flux as the launch package passes the selected positions to compensate for diffusive losses of the first magnetic flux.

17. The electromagnetic railgun of claim 16 wherein the means for temporarily trapping the second magnetic flux includes a plurality of resistors distributed along the bore, wherein each resistor is positioned for electrical connection between at least one of the elongated bus-bars and the launch package as the launch package passes the resistor.

* * * * *

UNITED STATES PATENT AND TRADEMARK OFFICE

CERTIFICATE OF CORRECTION

PATENT NO. : 5,483,863

DATED : January 16, 1996

INVENTOR(S) : YURI A. DREIZIN

It is certified that error appears in the above-indentified patent and that said Letters Patent is hereby corrected as shown below:

Col. 10, line 6, delete "/", after "electromagnetic"

Col. 10, line 31, delete "$t_p321_a/v$", insert --$t_p=1_a/v$--

Col. 10, line 31, delete "1", insert --$l_a$

Col. 10, line 40, delete "PE-$L_gI_a$/21 a, insert --$E=L_gI^2/2*l_a$--

Col. 13, line 11, delete "abovedescribed", insert —above–described—

Col. 14, line 16, delete "bole" insert --bore--

Col. 14, line "63, delete "railgun", insert --railguns--

Signed and Sealed this

Second Day of July, 1996

*Attest:*

*Attesting Officer*

BRUCE LEHMAN

*Commissioner of Patents and Trademarks*

Disclaimer and Dedication 5,483,863 - Yuri A. Dreizin, Minneapolis, Minn. ELECTROMAGNETIC LAUNCHER WITH ADVANCED RAIL AND BARREL DESIGN. Patent dated Jan. 16, 1996. Disclaimer and Dedication filed Apr. 19, 1999, by the assignee, Dyuar Incorporated.

Hereby disclaims and dedicates to the Public the entire term of said patent.

*(Official Gazette,* June 22, 1999)